US008029336B1

(12) United States Patent
Thomas et al.

(10) Patent No.: US 8,029,336 B1
(45) Date of Patent: Oct. 4, 2011

(54) GLASS GRINDING SYSTEM AND METHOD

(75) Inventors: Keith Thomas, Lafayette, CA (US); Richard Evans, Arroyo Grande, CA (US); Cody Thomas, Walnut Creek, CA (US); Adam Thomas, Camarillo, CA (US)

(73) Assignee: The Redd Group, LLC, Lafayette, CA (US)

( * ) Notice: Subject to any disclaimer, the term of this patent is extended or adjusted under 35 U.S.C. 154(b) by 715 days.

(21) Appl. No.: 12/082,308

(22) Filed: Apr. 10, 2008

Related U.S. Application Data

(60) Provisional application No. 60/923,206, filed on Apr. 13, 2007.

(51) Int. Cl.
*B24B 7/24* (2006.01)

(52) U.S. Cl. ..... 451/41; 451/57

(58) Field of Classification Search ..... 451/41, 451/57–58, 37

See application file for complete search history.

(56) References Cited

U.S. PATENT DOCUMENTS 4,438,598 A * 3/1984 Wohlmuth ..... 451/5
5,584,146 A * 12/1996 Shamouillan et al. ..... 51/293
6,203,403 B1 * 3/2001 Odstrcil et al. ..... 451/28
6,638,144 B2 * 10/2003 Sventek et al. ..... 451/41

* cited by examiner

*Primary Examiner* — Robert Rose
(74) *Attorney, Agent, or Firm* — Law Offices of Thomas E. Schatzel, A Prof. Corp.

(57) ABSTRACT

A glass grinding method starts with an assessment of the scratch or surface defect to be removed. A series of abrasive pads with different diameters and different grits from 60, 120, 180, 220, and 400 grit are selected according to the depth of the scratches or defects on the glass, and is installed on a handheld circular grinder. The work area is restricted to an imaginary area around the scratch that is two times the length of the scratch squared. The area is worked and feathered out with successively finer and finer dry abrasive pads applied flat on the surface of the glass. During this process, the glass surface temperatures are monitored and not allowed to exceed 150° F. Any glass powders that stick and build up on the abrasive disk faces are knocked off by slapping them with wire brushes or rasps. They are not brushed off. In a final pre-polishing stage, the powders are allowed to build to gradually reduce the cutting action and produce a finer surface. When the glass has only a haze left to remove, cerium oxide powders mixed in water are misted from a spray bottle onto a felt pad installed on the grinder. The area is outlined with a dry-grease marker applied on the backside of the glass.

6 Claims, 2 Drawing Sheets

GLASS GRINDING SYSTEM AND METHOD

RELATED APPLICATIONS

This Application claims benefit of U.S. Provisional Patent Application Ser. No. 60/923,206, filed Apr. 13, 2007.

BACKGROUND OF THE INVENTION

1. Field of the Invention

The present invention relates to surface polishing systems and methods, and in particular to dry systems that prevent the possibility of dropping liquids that can stain surrounding structures, and ones that use successively finer grits to remove deep scratches in glass and to feather out the work area to avoid optical distortions.

2. Description of the Prior Art

Window glass often gets scratched or marred in normal use over time, and can be very expensive and difficult to replace. Many office and government buildings now use glass for walls and windows, and are the object of vandalism. Particularly bad vandals and graffiti taggers will use sharp tools to scratch glass. Some are even using acids and dyes that etch into the glass and leave permanent stains that cannot be simply wiped off with cleaners and solvents.

Building owners and maintenance need less costly alternatives than outright replacement. Glass grinding systems that can deliver repair costs 50% of outright glass replacement would be useful and needed. But many conventional glass grinding systems depend on liquids, slurries, and other wet systems that require containment and special work conditions. The liquids can often get away from the work and stain nearby window frames, floors, and furniture.

SUMMARY OF THE INVENTION

Briefly, a glass grinding method embodiment of the present invention comprises an assessment of the surface defect to be removed. A series of abrasive pads, e.g. silicon carbide with different diameters and different grits from 60, 120, 180, 220, and 400 grit are selected according to the depth of the scratches or defects on the glass is installed on a handheld circular grinder. The work area is restricted to an imaginary area around the scratch that is two times the length of the scratch squared. The area is worked and feathered out with successively finer and finer dry abrasive pads applied flat on the surface of the glass. During this process, the glass surface temperatures are monitored and not allowed to exceed 150° F. Any glass powders that stick and build up on the abrasive disk faces are knocked off by slapping them with wire brushes or rasps. They are not brushed off. In a final pre-polishing stage, the powders are allowed to build to gradually reduce the cutting action and produce a finer surface. When the glass has only a haze left to remove, cerium oxide powders mixed in water are misted from a spray bottle onto a felt pad installed on the grinder. The area is outlined with a dry-grease marker applied on the backside of the glass.

A series of silicon carbide abrasive pads in embodiments of the present invention comprises silicon carbide on paper backings glued to a padded loop matrix 0.125" thick and in a round disk between two and eight inches in diameter and with a one inch hole in the center. The loop matrix snags and attaches easily to a Velcro-like surface on a drive hub mounted to a grinder chuck. The padded loop matrix has a degree of flexibility empirically derived, and there are only a very few commercial suppliers of silicon carbide abrasives on papers that perform as needed.

These and other objects and advantages of the present invention will no doubt become obvious to those of ordinary skill in the art after having read the following detailed description of the preferred embodiments that are illustrated in the various drawing figures.

IN THE DRAWINGS

DETAILED DESCRIPTION OF THE PREFERRED EMBODIMENT

Figure 1:
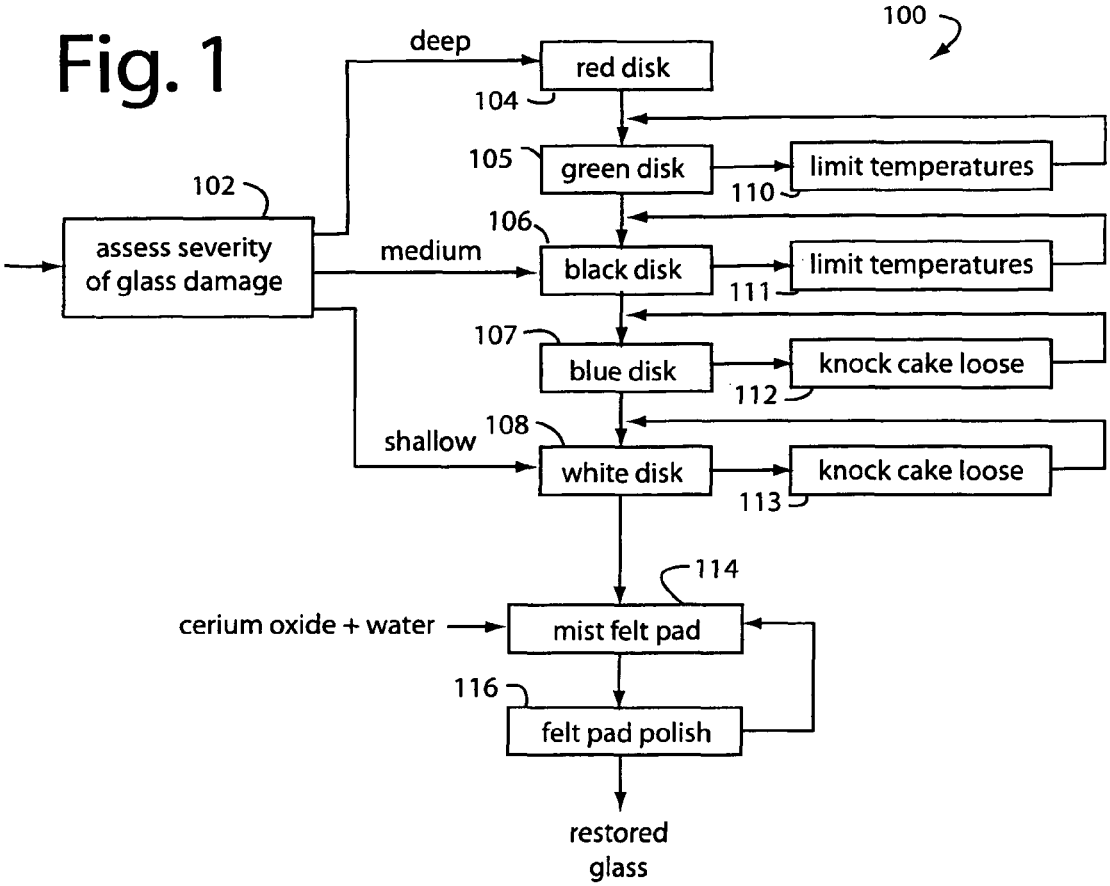
FIG. 1 is a flowchart diagram of method embodiment of the present invention for grinding flat glass with surface scratches.

FIG. 1 represents a glass grinding method embodiment of the present invention, herein referred to by the general reference numeral 100. Method 100 starts with a step 102 that makes an assessment of the scratch or surface defect to be removed. If a user's fingernail does not catch on the scratch when dragged across, then the scratch can be estimated to be shallow. If the user's fingernail does catch on the scratch when dragged across, then the scratch can be estimated to be at least medium. And, if the edges of the scratch show glass flaking and chipping, then the scratch is judged to be deep.

A series of dry silicon carbide abrasive pads with different diameters and different grits from 60, 120, 180, 220, and 400 grit are selected in steps 104-108 according to the depth of the scratches or defects on the glass. The appropriate silicon carbide abrasive pad to begin with is installed on a handheld circular grinder.

In one embodiment of the present invention, 60-grit abrasive disks are color coded red, 120-grit abrasive disks are color coded green, 180-grit abrasive disks are color coded black, 220-grit abrasive disks are color coded blue, 400-grit abrasive disks are color coded white. The abrasive disks must have a certain degree of flexibility, and are generally limited to working on relatively flat surfaces because the disks must be pressed against the glass workpiece without applying substantial unequal pressure to the edges. This generally means commercially available abrasives on paper backings are preferably mounted to a one-eighth inch thick round disk fiber matrix resembling coarse horsehair padding though other forms of cushioning may adequately perform. The actual abrasive material must be silicon carbide ($S_iC$), better known by one product trademarked CARBORUNDUM. Only one manufacturer's commercial product in the world has been indentified as acceptable, e.g., the model CP918A and equivalents from VSM Abrasives (O'Fallon, Mo.). See, www.vsmabrasives.com/products. VSM Abrasives itself identifies model CP918A as not having a glass application, only wet/dry uses for metal, wood, and "other" soft surfaces.

The work area in each step 104-108 is restricted to an imaginary area around the scratch that is roughly two times the length of the scratch squared. For example, a scratch four inches long will have a work area eight inches by eight inches.

The area is worked and feathered out in steps 104-108 with successively finer and finer dry abrasive pads applied flat on the surface of the glass. During this process, the glass surface temperatures are monitored and not allowed to exceed 150° F.

Such temperature monitoring is represented in FIG. 1 by steps 110 and 111 for green disk step 105 and black disk step 106, but limiting the workpiece surface temperatures is important in all steps where the glass is being ground or polished.

Any glass powders that stick and build up on the abrasive disk faces are knocked off in steps 112 and 113 by slapping them with wire brushes or rasps. The powders that cake on are not brushed off. Such knocking of the glass powder cake loose is represented in FIG. 1 by steps 111 and 112 for blue disk step 107 and white disk step 108, but removing the glass powder caking is important in all steps 104-108.

In a final pre-polishing phase within white disk step 108, the glass powders are allowed to build to gradually reduce the cutting action and produce a finer surface on the glass work area.

When the glass work area has only a haze left to remove, cerium oxide powders mixed in water are lightly misted in a step 114 from a spray bottle onto a felt pad installed on the grinder in a step 115. Cerium oxide is also a principal component in so-called jeweler's rouge. The work area can be outlined with a dry-grease marker applied on the backside of the glass. Otherwise, it can be hard to see where to continue the work.

Figure 2:
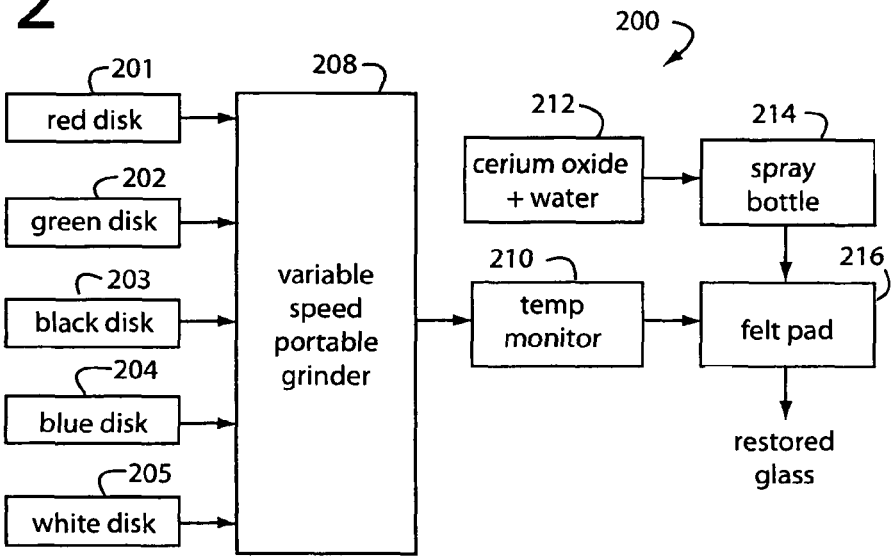
FIG. 2 is a functional block diagram of system embodiment of the present invention for grinding flat glass with surface scratches.

A glass grinding system embodiment of the present invention is represented in FIG. 2, and is referred to herein by the general reference numeral 200. System 200 includes a 60-grit abrasive disk 201 color-coded red, a 120-grit abrasive disk 202 color-coded green, a 180-grit abrasive disk 203 color-coded black, a 220-grit abrasive disk 204 color-coded blue, and a 400-grit abrasive disk 205 color-coded white. Such disks come in a variety of sizes; e.g., 2", 3", 4", 5", 6", 7" and 8" in diameter, ⅛" thick, and with a 1" hole in the center. The paper-backed silicon carbide abrasive sheets are permanently bonded with very strong adhesives to coarse fiber cushioning material. For example, a synthetic fiber felt resembling a loop type carpet. These quickly attach to a variable speed portable grinder 208 with a flat hub using a conventional two-part fabric hook-and-loop fastener system similar to trademarked products from Velcro Industries, BV (Manchester, N.H.).

There will be some commercial advantage to hiding the maker's name and product model numbers from the users. Users or competitors may try to assemble their own abrasive disks 201-205, but would probably fail in duplicating the good results obtained here if they did not discover the surprising application of VSM model CP918A in this use. Similar products from other manufacturers do not seem to perform as well. So embodiments of the present invention depend on keeping their trade secrets by either removing the product and supplier identity from the paper backing, or by using the very strong adhesive bond to the fabric matrix cushioning to keep the identity from being read.

In general, the 5" diameter and larger size disks 201-205 are used where the work areas will be large, e.g., more than 6-10 square feet. The smaller, 2", 3", and 4", sizes are used for work areas less that three square feet.

The system 200 can be marketed as part of a rolling workshop which is housed in a ruggedized and balanced field case. Such case includes a durable foam interior to hold the user's tools snuggly, has press and pull latches to hold fast, a Vortex™ valve to automatically adjust air pressure without letting in water. Telescoping handles, rugged in-line wheels, and double-layered, soft-grip handles are included for strength and comfort.

Scratch removal system embodiments of the present invention are intended for use by, but not limited to, glass repair professionals and dealers, high volume maintenance and repair depot technicians, and graffiti removal specialists.

Compared to conventional products and methods, scratch removal system embodiments of the present invention use a simplified two-step grinding/polishing process that removes scratches or acid damage of all sizes quickly, and with no discernable distortion.

The streamlined process is made possible through the use of uniquely designed and color-coded abrasive disks for "selective" grinding in the first stage of scratch removal. Selective grinding means using pre-determined sizes up to eight-inch diameter, and color of disk for the grinding range best suited to the depth and type of scratch. The system helps to take much of the guesswork out of scratch removal.

Abrasive disks 300 cushion the disk during aggressive grinding. Such allows for significant stock removal to effectively eliminate scratches much deeper than other commercial products, without the worry of creating swirls or leaving distortion in the glass.

A second-stage polishing is enhanced by a polishing compound of cerium oxide powder and water. When used with the polishing equipment provided with system 200, the polishing time required to finish the repair is dramatically reduced, thereby making the operator more productive and the equipment more cost efficient to use.

Figure 3A:
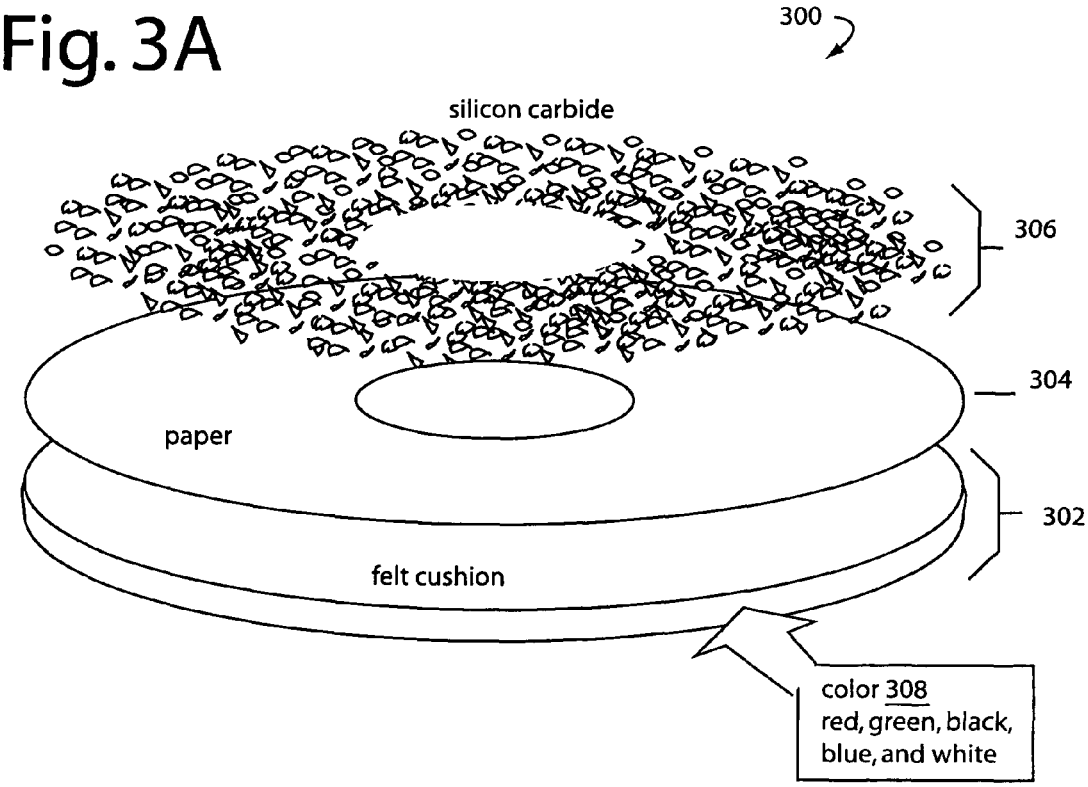
FIGS. 3A and 3B are exploded assembly and perspective view diagrams of an abrasive disk embodiment of the present invention.
Figure 3B:
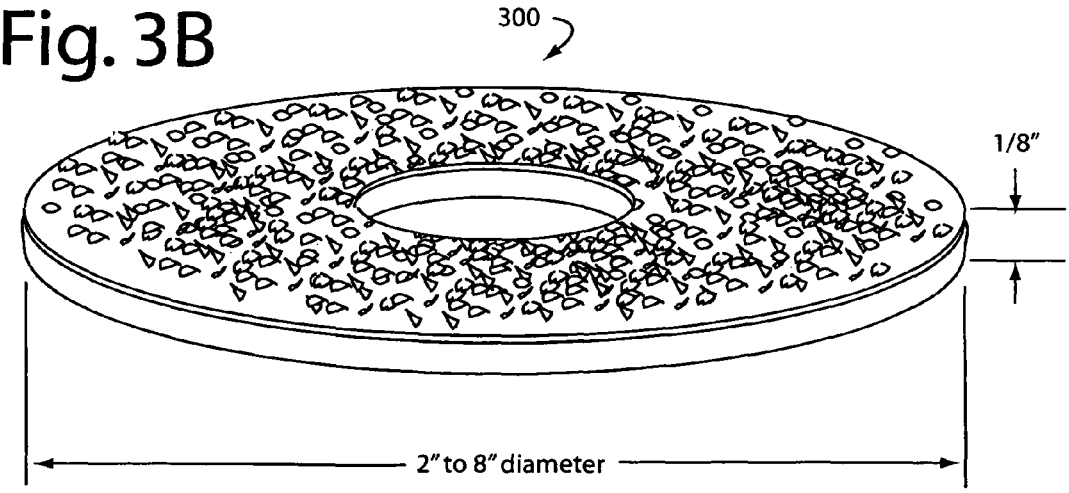

FIGS. 3A and 3B represents an abrasive disk 300 for grinding flat glass when dry. Disk 300 comprises a loop-type felt cushioning 302 providing for a planar foundation, and is generally in the shape of a round disk. A paper-backing 304 is bonded with adhesives to the cushioning 302. A coating 306 of silicon carbide abrasives classified into a particular grit is disposed on the working surface of the paper-backing 304. The whole is about 2" to 8" in diameter, ⅛" in thickness, and flexible.

The abrasive disk 300 can further comprise a coloring 308 disposed in the felt cushioning for color-coding the abrasive disk to users according to a corresponding grit classification which can range from 60-grit to 400-grit. 14. The abrasive disk of claim 12, further comprising a centrally located hole about one inch in diameter.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. A glass grinding method, comprising:

assessing the severity of a scratch in the surface of a flat glass to be one of shallow, medium, or deep;

establishing a work area boundary around said scratch;

selecting and mounting an abrasive disk on a portable rotary grinder wherein a particular starting grit of an abrasive paper depends on the assessment of said scratch being shallow, medium, or deep;

grinding said flat glass in said work area by keeping a selected abrasive disk flat down and dry;

stepping to a next finer grit abrasive disk until a final abrasive disk has concluded its grinding of said flat glass in said work area; and removing a residual haze on the surface of said flat glass in said work area with a felt pad misted with water and cerium oxide and mounted to said portable rotary grinder.

2. The method of claim 1, further comprising:

limiting the surface temperatures of said flat glass in said work area by monitoring with a thermometer and interrupting said step of grinding to allow a cooling down.

3. The method of claim 1, further comprising:

cleaning accumulations and caking of glass powder on said abrasive disks in the step of grinding by slapping the working surfaces of said abrasive disks with a wire brush or rasp.

4. The method of claim 1, further comprising:

marking said work area boundary on the reverse side of said flat glass with a dry erase marker so the work area is not lost by a user in the final steps.

5. The method of claim 1, further comprising:

color-coding said abrasive disks according to their respective grits which range from 60-grit to 400-grit.

6. The method of claim 1, further comprising:

choosing different diameters of said abrasive disks according to the size of said work area.

* * * * *